US005170907A

United States Patent [19]

Sakai

[11] Patent Number: 5,170,907

[45] Date of Patent: Dec. 15, 1992

[54] PERSONAL SECURITY CASE

[76] Inventor: Nobuyo Sakai, 6-27-3, Komagome, Toshima-ku, Tokyo, Japan

[21] Appl. No.: 791,246

[22] Filed: Nov. 13, 1991

[30] Foreign Application Priority Data

Nov. 13, 1990 [JP] Japan ..... 2-306411

[51] Int. Cl.[5] ..... B65D 25/22

[52] U.S. Cl. ..... 220/481; 220/4.22; 220/211; 220/325; 248/553; 109/52

[58] Field of Search ..... 220/480, 481, 4.22, 220/211, 324, 325, 334, 342, 343, 737; 109/47, 50, 52, 59 R, 59 R; 248/551, 553

[56] References Cited

U.S. PATENT DOCUMENTS

| | | | |
|---|---|---|---|
| 2,410,475 | 11/1946 | Anderson | 109/52 |
| 2,748,973 | 6/1956 | Rockola | 220/481 |
| 2,759,623 | 8/1956 | Hammarquist | 220/481 |
| 4,244,304 | 1/1981 | Read | 109/52 |
| 4,493,268 | 1/1985 | Sidler | 109/52 |
| 4,524,904 | 6/1985 | Masse et al. . | |
| 4,577,563 | 3/1986 | Sidler | 109/52 |
| 4,946,057 | 8/1990 | Connolly et al. | 220/481 |
| 4,987,836 | 1/1991 | Owen | 109/52 |

FOREIGN PATENT DOCUMENTS

| | | | |
|---|---|---|---|
| 0543350 | 7/1957 | Canada | 220/481 |
| 3740960 | 6/1989 | Fed. Rep. of Germany . | |

*Primary Examiner*—Stephen Marcus
*Assistant Examiner*—Stephen Cronin
*Attorney, Agent, or Firm*—Wenderoth, Lind & Ponack

[57] ABSTRACT

The present invention relates to a personal security case which includes a holder attached to a wall or the like, and a security case removably held by the holder. The security case has a case body and a lid which is attached to the case body in such a manner as to be opened and closed as desired. The personal security case also includes a lock mechanism provided thereon to enable the case body and the lid to be locked respectively to the holder and to the case body in a closed state either simultaneously or independently and to further permit unlocking of the case body and the lid either simultaneously or independently.

10 Claims, 8 Drawing Sheets

PERSONAL SECURITY CASE

BACKGROUND OF THE INVENTION

1. Field of the Invention

The present invention relates to a personal security case which can be used in two ways, namely, as either a container attached to a holder or as a handbag when removed from the holder.

2. Prior Art

Portable bags and cases which are carried outdoors vary in size according to use. Handbags which can be carried under a person's arm or security cases which can be readily accommodated in handbags are suitable for carrying small articles, for example, a small sum of cash, credit cards, writing instruments, memo paper, etc. Unlike men, who carry a relatively small number of personal effects, women usually carry a relatively large number, for example, toilet articles. In particular, women responsible for the running of a household must keep a number of small articles together in one place. These may include a sum of money, shopping receipts, a bankbook, a cash or credit card and so on. Needless to say, it is also often necessary for such items to be used outside the home. As such, security cases can be a useful means for carrying some small articles.

Conventional security cases are made sufficiently strong to be fit for both outdoor and indoor use, so that they are durable even if handled somewhat roughly. When a user returns home with a security case in a handbag or the like, it is common for the user to place the security case in a drawer in a cupboard or the like. However, when an article contained in the security case is needed, it is necessary to open the drawer in a cupboard or the like and locate the security case and then remove the necessary article. Such a procedure can be troublesome when a user is pressed for time. Besides, when the security case has not been put in its user place, it becomes necessary to expend time and effort in attempting to locate the security case. In addition, since the privacy of the individual must be respected even in a family, it is desirable for security cases to be provided with a lock and key. However, no structure with a lock and key, such as that of a simple small-sized safe, has even been employed partly because the concealment of a secret place is regarded as serving as a kind of lock.

SUMMARY OF THE INVENTION

It is a principal object of the present invention to provide a personal security case which is designed so that it can be used as a simple container that is fixed in a home within a holder to keep a small sum of cash, receipts or other small articles, which are required in the running of a household, and it can also be used as a handbag by being removed from the holder.

To achieve this object, the present invention provides a personal security case which comprises a holder attached to a wall or the like, a security case removably held by the holder, the security case comprising a case body and a lid which is attached to the case body in such a manner as to be easily opened and closed as desired, and a lock mechanism provided on the security case to enable the case body and the lid to be locked, respectively, to the holder and to the case body in a closed state either simultaneously or independently and to further permit unlocking either simultaneously or independently.

When the case body is engaged with the holder, the security case can be used indoors as a fixed container. Even if the security case is located in an easily accessible place, since only the person who possesses the key can lock and unlock the lid covering the case body, it is unnecessary to conceal the place where the security case is kept. Thus, the privacy of the individual can be maintained, and the security case can be used as a simple container which may be conveniently hung on a wall or the like.

On the other hand, when the security case is removed from the holder by unlocking the case body from the holder, since the lid can be locked to or unlocked from the case body as desired, the security case can be used as a handbag or as an accessory case with a lock and key which may be accommodated in a handbag. Thus, it is possible to carry articles (for example, a bankbook etc.), which are necessary for business, to outdoor places in the security case without the need to transfer them into a handbag.

The personal security case may have a slot provided in the case body. This security case enables a document or the like to be inserted through the slot into the security case with the lid being left locked to the case body. It is thus possible to use the security case in a fixed position outdoors, like a mailbox with a lock mechanism. Thus, the range of use of the security case is expanded.

BRIEF DESCRIPTION OF THE DRAWINGS

FIGS. 3(A), 3(B) through FIGS. 5(A) and 5(B) are plan and side views illustrating ways of using the personal security case shown in FIG. 1.

DETAILED DESCRIPTION OF THE PREFERRED EMBODIMENTS

Figure 1:
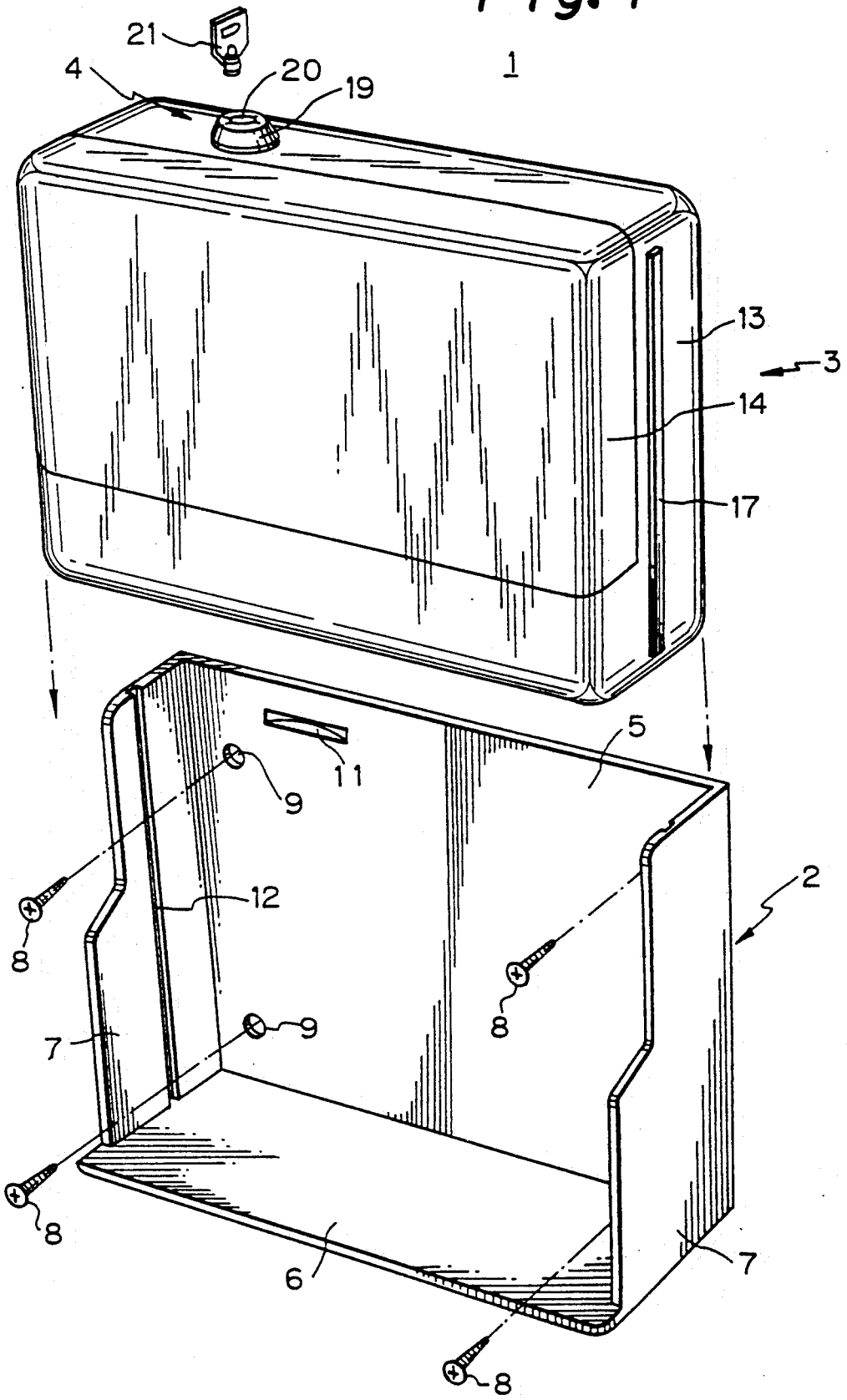
FIG. 1 is a perspective view of one embodiment of the personal security case according to the present invention.

Referring to FIG. 1, a personal security case 1 comprises a holder 2 attached to the wall of a kitchen, for example, a security case 3 removably held on the holder 2, and a lock mechanism 4 that enables the security case 3 to be locked itself and to the holder 2.

The holder 2 comprises a rear plate 5, a bottom plate 6 and a pair of left and right side plates 7, which are integrally formed of a metallic material by a die casting process. The rear plate 5, which is secured to a vertical wall by means of four fastening screws 8, is provided with four through-holes 9 for the screws 8, and an engagement groove 11 which receives a three-way pawl member 10 (described later) of the lock mechanism 4. The inner sides of the left and right side plates 7 are provided with vertically extending straight guide grooves 12, respectively, for guiding the security case 3 to an accommodation position.

Figure 3C:
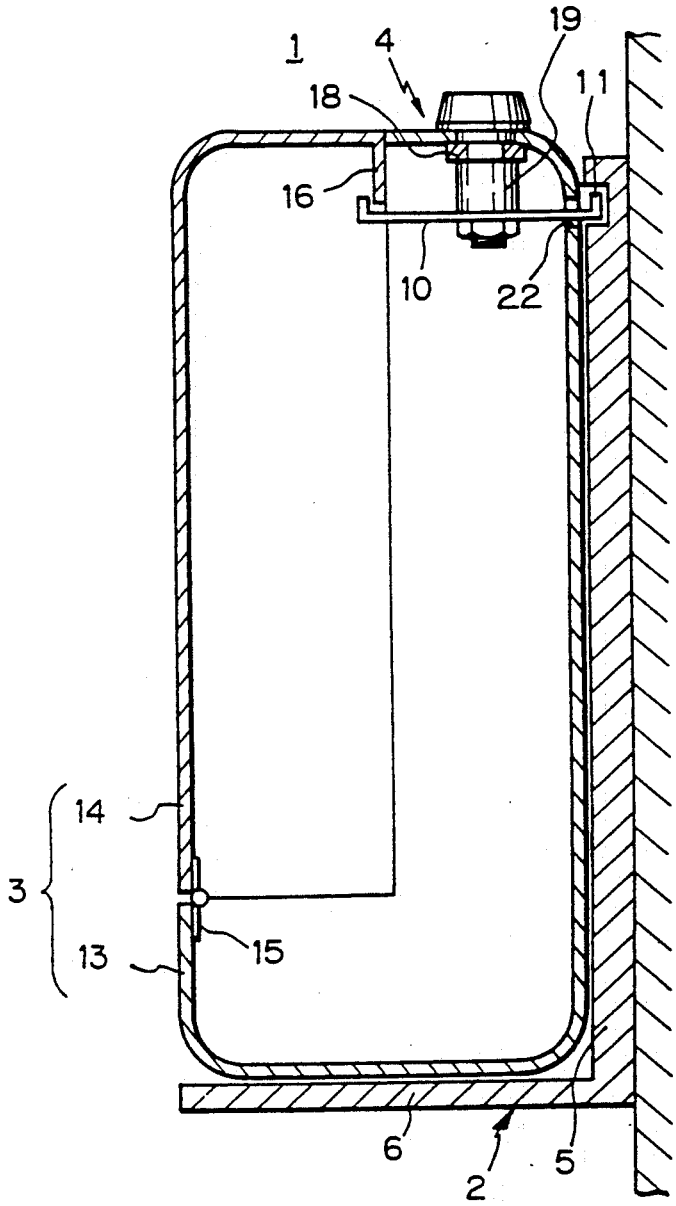
FIG. 3(C) is an enlarged sectional view taken along line IIIC—IIIC of FIG. 3(A).

The security case 3 comprises a basket-shaped case body 13 having such a size that it fits snugly into the holder 2 from the upper side of the latter, and a lid 14 that is pivotably attached to the case body 13 to cover the front opening of the case body 13. The lid 14 is attached to the case body 13 through hinges 15 as shown in FIG. 3(C) so that is can be opened and closed as desired. A portion 16 of the lid 14 that abuts the upper edge of the case body 13 when the lid 14 is closed is bent inwardly and this bent portion 16 is is engageable by the lock mechanism 4. The left and right outer side portions of the case body 13 are provided with continuous ridges 17, respectively, which fit within the guide grooves 12 of the holder 2 to serve as guide members which are used when the case body 13 is held within the holder 2 and also to prevent the case body 13 from falling forward from the holder 2.

Figure 2:
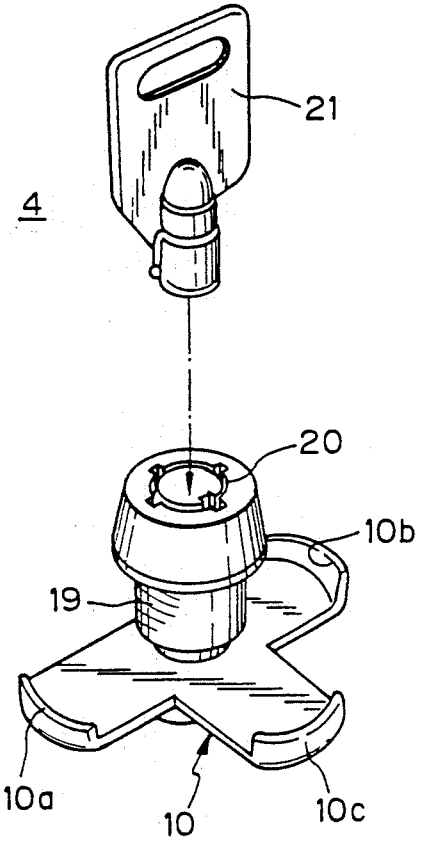
FIG. 2 is an enlarged perspective view of an essential part of a lock mechanism shown in FIG. 1.

The lock mechanism 4 comprises a lock 19 that extends through the top plate of the case body 13 at a predetermined position and that is secured to the top plate by means of a securing nut 18, a three-way pawl member 10 that is forced to rotate by rotation of an exclusive key 21 when the key 21, which is inserted into an annular keyhole 20 formed in the top of the lock 19, is rotated, and the engagement groove 11 and the bent portion 16 described hereinabove (which are provided on the holder 2 and the lid 14, respectively) that engage the three-way pawl member 10. Reference numeral 22 denotes a window that is formed in the case body 13 to serve as a passage for guiding the three-way pawl member 10 into the engagement groove 11 in the holder 2 when the case body 13 is held within the holder 2. As shown in FIG. 2, the three-way pawl member 10 has three pawl portions each having its distal end bent upwardly, that is, a pair of left and right pawl portions 10*a* and 10*b*, and another pawl portion 10*c* which extends at right angles to the former pawl portions 10*a* and 10*b*. These pawl portions 10*a* to 10*c* enable the case body 13 and the lid 14 to be locked in accordance with the rotational position of the three-way pawl member 19. These positions are established when the key 21 inserted into the keyhole 20 and is rotated by 90 degrees at a time.

For example, a lock mechanism 4 manufactured by K. K. Daiwa Lock (Japan) may be employed in this embodiment.

Next, the operation of the personal security case will be described.

Figure 3A:
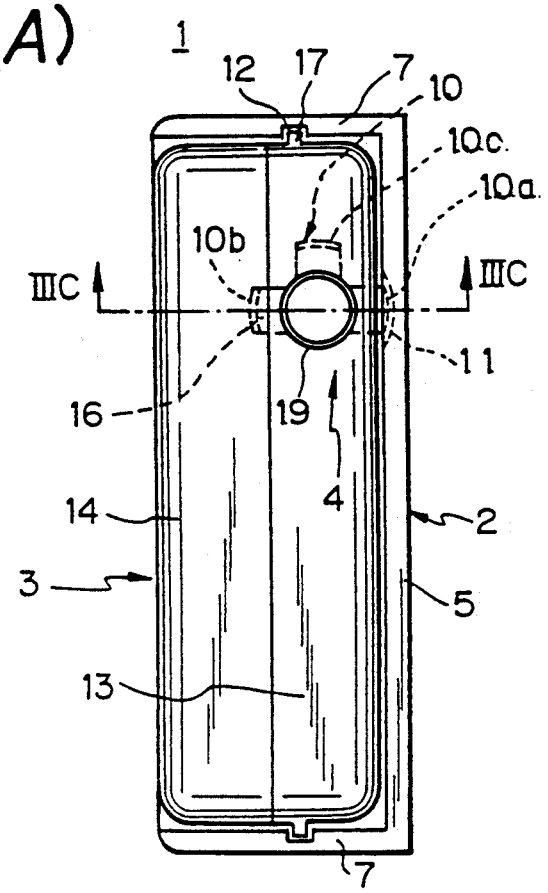
Figure 3B:
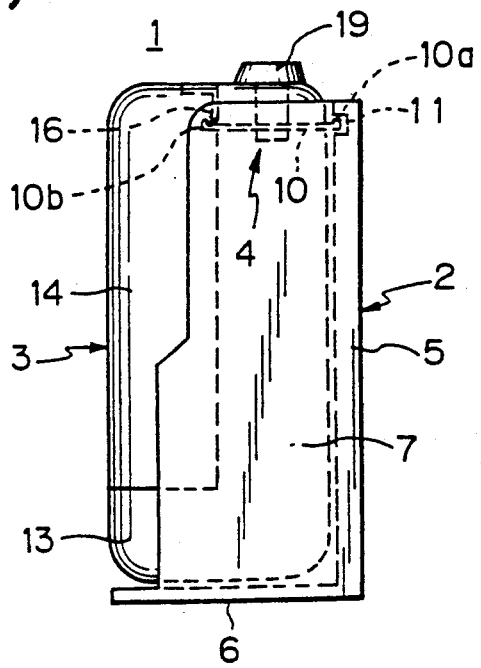

When the personal security case 1 is to be used indoors, the case body 13 is held within the holder 2 with the ridges 17 received in the respective guide grooves 12, as shown in FIGS. 3(A) and 3(B). The case body 13 is locked to the holder 2 by the lock mechanism 4 and, at the same time, the lid 14 is also locked to the case body 13 in a closed state. More specifically, the first pawl portion 10*a* is engaged with the holder 2 within the engagement groove 11 of the holder 2 to prevent the case body 13 from moving upwardly. At the same time, the second pawl portion 10*b* is engaged with the bent portion 16 to prevent their lid 14 from opening forwardly. Accordingly, both the case body 13 and the lid 14 are locked simultaneously, so that no one can see nor take out the contents of the security case 3 except for the person who possesses the key 21.

Figure 4A:
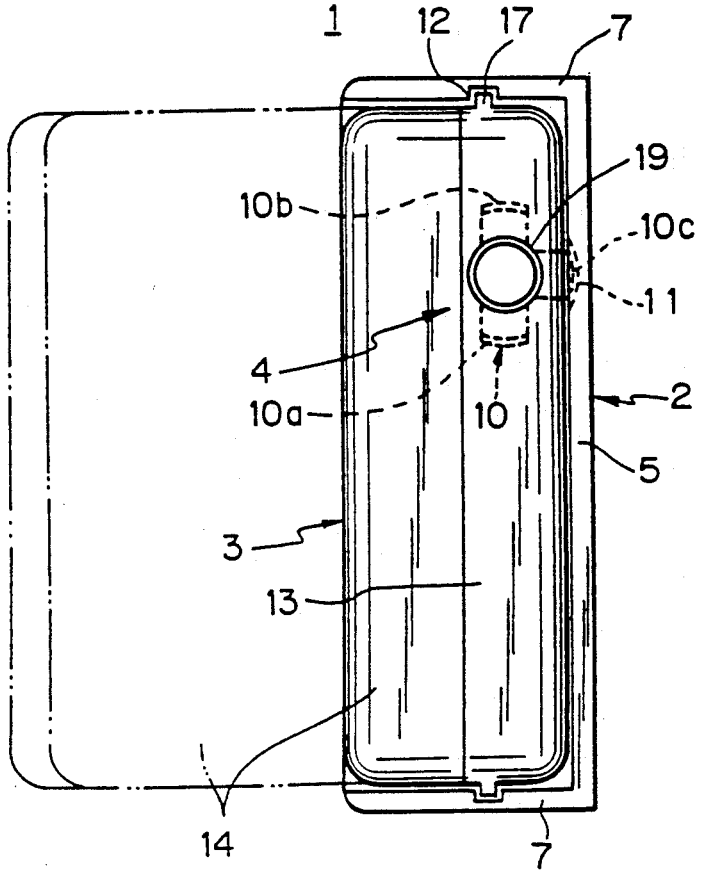
Figure 4B:
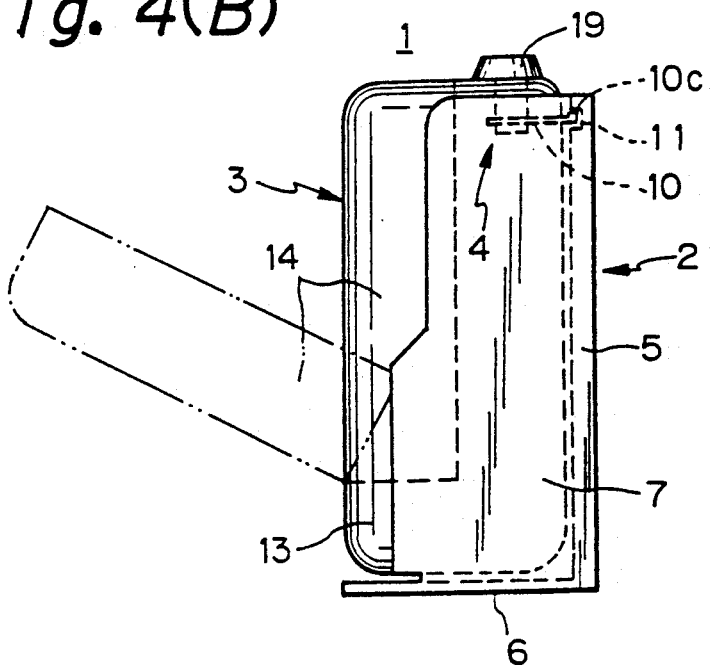

When a necessary article is to be taken out from the security case 3 held within the holder 2, the key 21 is inserted into the keyhole 20 of the lock 19 and is rotated by 90 degrees in a clockwise direction from the position shown in FIG. 3 to the position shown in FIG. 4. Consequently, the lock mechanism 4 allows the second pawl portion 10*b* of the three-way pawl member 10 to disengage from the engagement portion 16 and causes the third pawl portion 10*c* to engage the holder 2 within the engagement groove 11 in place of the first pawl portion 10*a*. Thus, the lid 14 is released from the case body 13 with the case body 13 being left locked to the holder 2. Accordingly, the lid 14 can be pivoted about the hinge 15 to be opened by pulling it forward, as shown by the one-dot chain line in FIG. 4(B), so that is is possible to take out the contents from the case body 13 or to put another article therein.

Figure 5A:
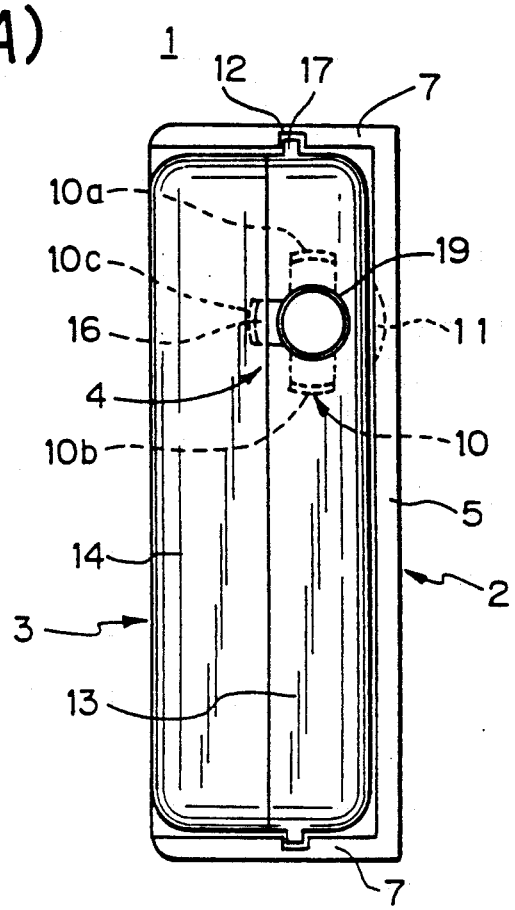
Figure 5B:
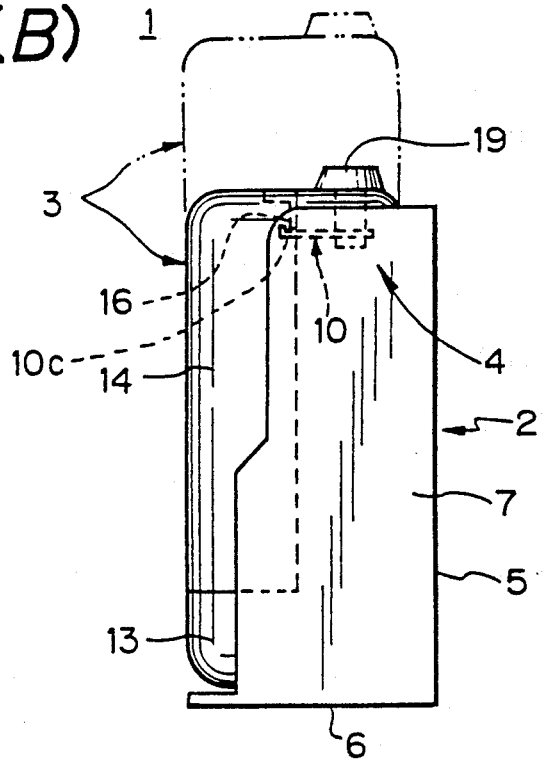

When the case 3 is to be removed from the holder 2 and to be carried by a user as a personal security case 3, the key 21 is rotated by 90 degrees in a counterclockwise direction from the position shown in FIG. 3 to the position shown in FIG. 5 in a reverse direction to that noted above. Consequently, the first pawl portion 10*a* of the three-way pawl member 10 constituting the lock mechanism 4 is moved out of the engagement groove 11, and the third pawl portion 10*c* is engaged with the engagement portion 16 in place of the second pawl portion 10*b*. Thus, the case body 13 is unlocked from the holder 2 with the lid 14 being left locked to the case body 13. Accordingly, the case body 13 can be removed from the holder 2 by pulling it upwards along the guide grooves 12, as shown by the two-dot chain line in FIG. 5(B). The security case 3 removed from the holder 2 allows the lid 14 to be able to be unlocked from the case body 13 only when the key 21 is inserted into the lock 19 and rotated through 180 degrees either in a clockwise or counterclockwise direction. Accordingly, the contents of the security case 3 can be concealed anywhere the user goes.

Thus, the personal security case 1 enables the security case 3 to be used indoors as a fixed container by locking the case body 13 to the holder 2. Only a person who possesses the key 21 can lock the lid 14 to the case body 13 and unlock it. Therefore, it is unnecessary to conceal the place where the security case 3 has been put. Thus, the privacy of the individual can be maintained, and the security case 3 can be used as a container hung on a wall or the like. It is also possible to utilize the security case 3 as a container for keeping articles, for example, a credit card, a bankbook, etc. In addition, when the security case 3 is removed from the holder 2 by unlocking the case body 13 from the holder 2, since the lid 14 can be locked to or unlocked from the case body 13 as desired, the security case 3 can be used as a handbag or can be used as an accessory case with a lock and key which may be accommodated in another handbag. Thus, since it is possible to carry articles (for example, a private seal, a bankbook, etc.) which are necessary for business to outdoor places, and to leave those articles being in the security case 3, there is no troublesome preparation of transferring those articles to a handbag before going outdoors.

Figure 6:
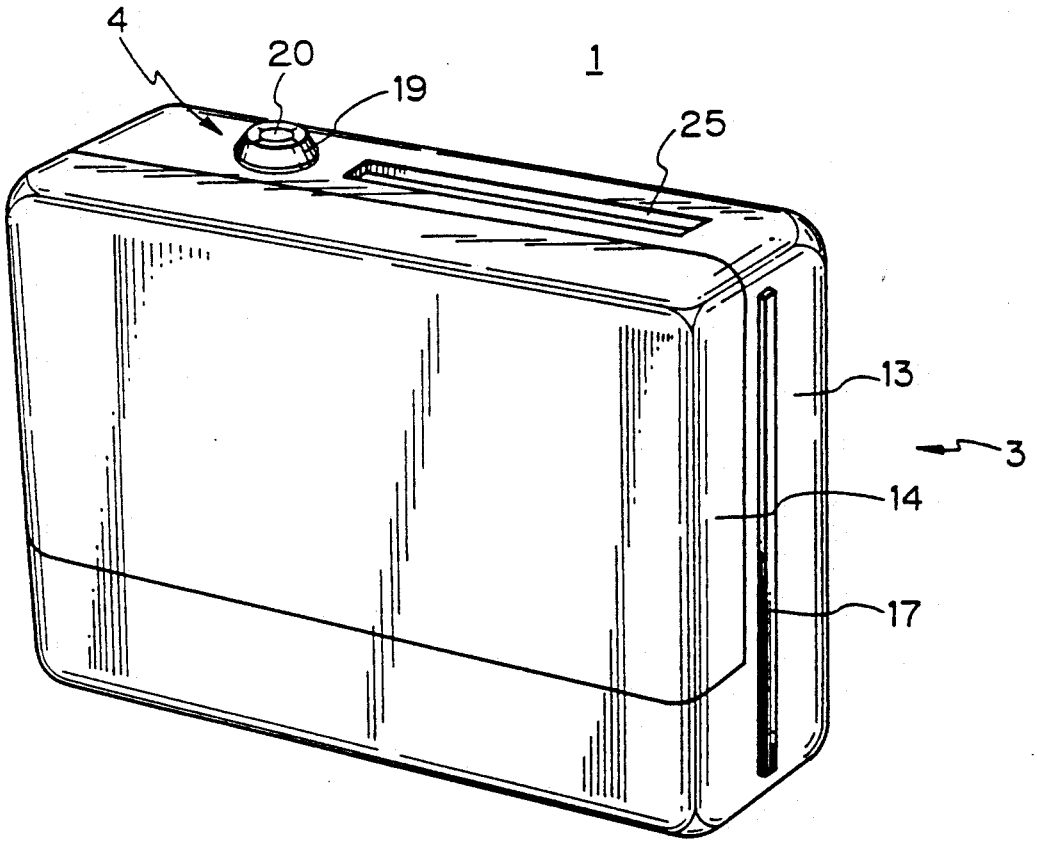
FIG. 6 is a perspective view of another embodiment of the personal security case according to the present invention.

FIG. 6 shows another embodiment of the personal security case according to the present invention. In FIG. 6, the same portions or members as those shown in FIG. 1 are denoted by the same reference numerals, and descriptions thereof are omitted. In the second embodiment, a slot 25 is provided on the top plate of the case body 13 of the security case 3. Accordingly, a document or the like can be inserted into the case 3 through the slot 25 with the lid 14 being left locked to the case body 13. In this case, the personal security case 3 may be fixed either indoors or outdoors by locking it to the holder 2 that is attached to an outer wall of a building, for example. In such a case, the security case 3 functions as a mailbox with a lock mechanism. Although in this embodiment the slot 25 is provided in the case body 13, it may be provided in the lid 14.

Figure 7:
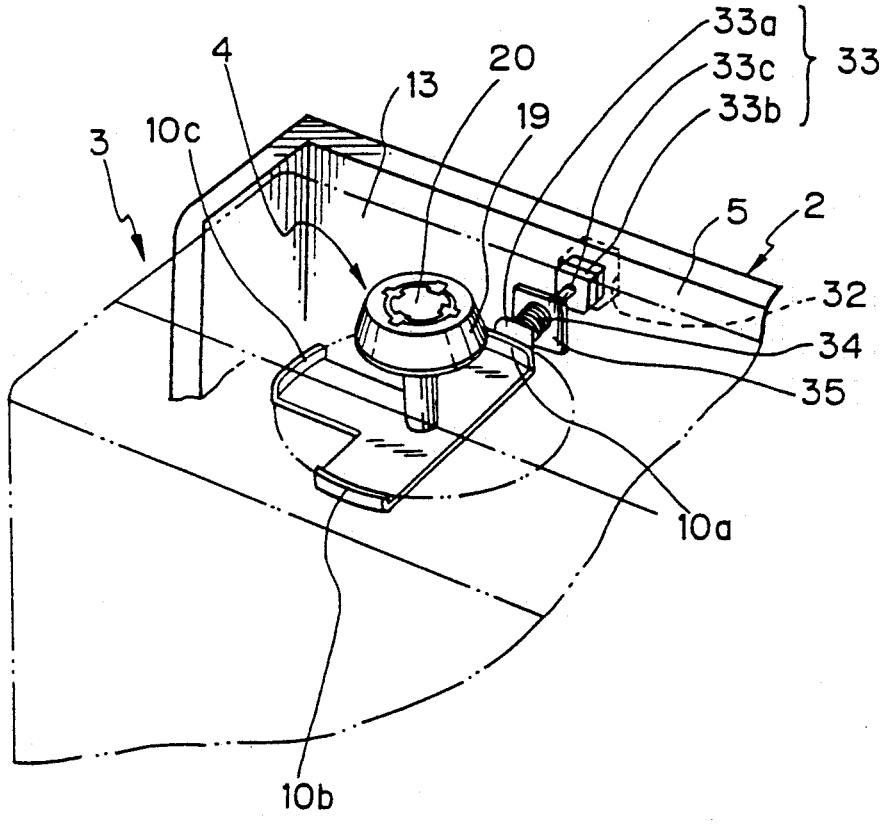
FIG. 7 is a fragmentary perspective view of an essential part of still another embodiment of the personal security case according to the present invention.
Figure 8:
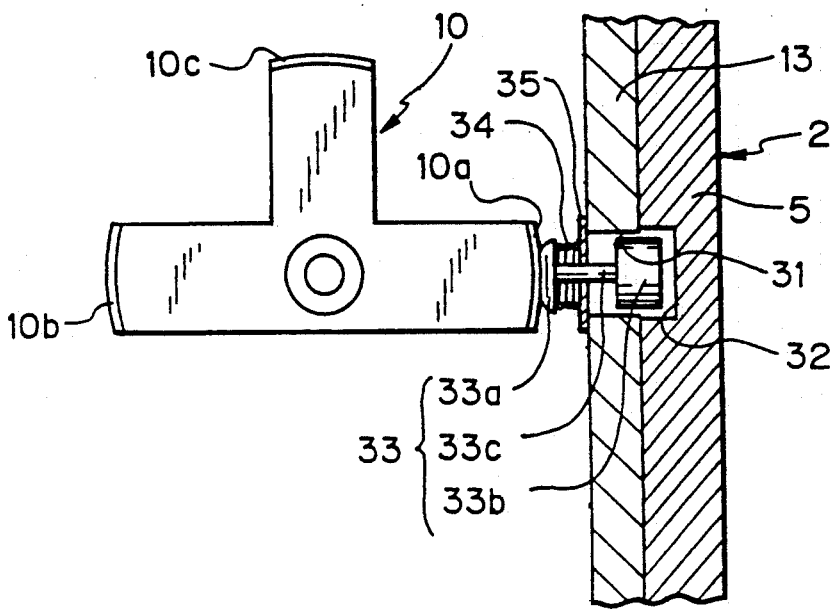
FIGS. 8 and 9 are fragmentary plan views illustrating ways of using the personal security case shown in FIG. 7.
Figure 9:
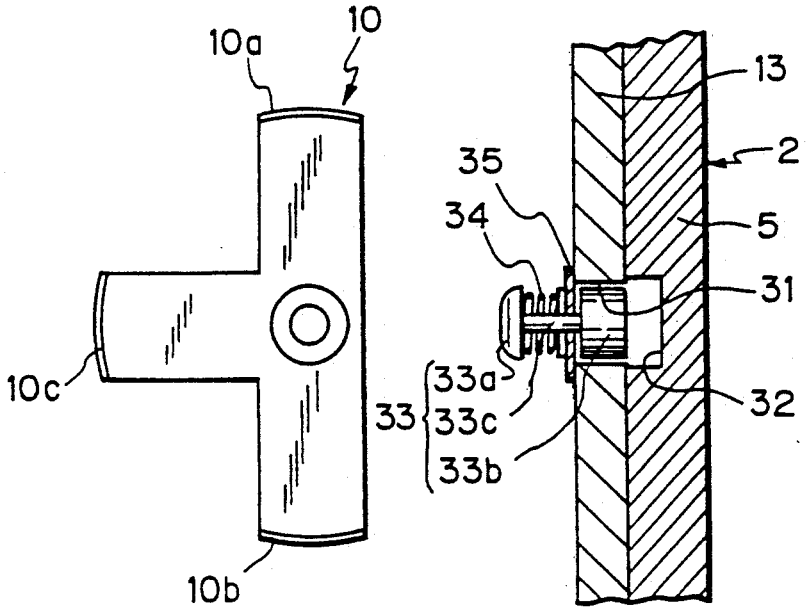

FIGS. 7 to 9 show still another embodiment of the personal security case according to the present invention. In FIGS. 7 to 9, the same portions or members as those shown in FIG. 1 are denoted by the same reference numerals, and descriptions thereof are omitted. In the third embodiment, a window 31 (FIGS. 8 and 9) is provided in the case body 13 of the security case 3, and an engagement groove 32 is provided on the rear plate 5 of the holder 2. Reference numeral 33 denotes a movable engagement member comprising a press portion 33*a* and an engagement portion 33*b*, which are connected to each other through a shaft 33*c* that extends through a fixed plate 35 (fixed to the case body 13). A coil spring 34 is provided between the press portion 33*a* and the fixed plate 35. The movable engagement member 33 is thus attached to the case body 13 through spring 34 and fixed plate 35.

FIG. 8 shows a state which is substantially similar to that shown in FIG. 3, in which the second pawl portion 10*b* of the three-way pawl member 10 is engaged with the engagement portion 16 (see FIG. 3) to keep the lid 14 locked to the case body 13. At this time, the movable engagement member 33, shown in FIG. 8, has the press portion 33*a* pressed by the first pawl portion 10*a* of the three-way pawl member 10, so that the movable engagement member 33 is pushed toward the holder 2 against the coil spring 34 to allow the engagement portion 33*b* to be engaged with the holder 2 within the engagement groove 32 of the holder 2. Thus, the lid 14 is locked to the case body 13 and, at the same time, the case 3 is locked to the holder 2.

The three-way pawl member 10 is first rotated by 90 degrees in a clockwise direction from the position shown in FIG. 8, to a state (not shown) which is substantially similar to that shown in FIG. 4. Therefore, although the case 3 is left locked to the holder 2, the lid 14 can be opened.

The three-way pawl member 10 is alternatively rotated by 90 degrees in a counterclockwise direction from the position shown in FIG. 8, to a state shown in FIG. 9, which is substantially similar to that shown in FIG. 5. At this time, the third pawl portion 10*c* of the three-way pawl member 10 is engaged with the engagement portion 16 (see FIG. 5) to keep the lid 14 locked to the case body 13. At the same time, the movable engagement member 33, shown in FIG. 9, is biased toward the three-way pawl member 10 by the coil spring 33*c*, so that the engagement portion 33*b* is moved out of the engagement groove 32 of the holder 2 and is accommodated within the window 31 in the case body 13. Accordingly, the case 3 can be removed from the holder 2 with the lid 14 being kept locked to the case body 13 in the same way as in the case of FIG. 5.

According to the embodiment shown in FIGS. 7 to 9, when the security case 3 is removed from the holder 2, neither the three-way pawl member 10 nor the movable engagement member 33 project outwardly from the external surface of the case body 13. Therefore, the security case 3 may be easily carried as it is free from projecting surfaces which could otherwise be an obstacle to handling.

Although in the foregoing embodiments the lock mechanism 4 is arranged such that the lock 19 is mechanically unlocked directly by means of the key 21, it should be noted that the described arrangement is not necessarily limitative and that the three-way pawl member 10 may be rotated, for example, by a pulse motor operated in response to a signal that is given remotely. In addition, the present invention is not necessarily limited to such a mechanical lock mechanism. For example, it is possible to employ a magnetic card type lock mechanism which is unlocked when an exclusive magnetic card is inserted therein and a specific code number of the magnetic card coincides with a code number which has been registered in advance.

What is claimed is:

1. A personal security case comprising:

a holder attachable to a wall or the like, said holder defining a first engagement portion;

a security case removably held by said holder, said security case defining a second engagement portion, and said security case comprising a case body and a lid which is attached to said case body in such a manner as to be easily opened and closed as desired; and a lock mechanism provided on said security case, said lock mechanism including a lock, a three-way pawl member rotatably supported on said lock and having three pawls, said three-way pawl member rotatable to and lockable at respective positions by said lock at which positions said first and said second engagement portions are engaged by respective pawls of said three-way pawl member, only said first engagement portion is engaged by a said pawl of said three-way pawl member, and only said second engagement portion is engaged by a said pawl of said three-way pawl member such that said case body and said lid are lockable to said holder and to said case body in a closed state, respectively, both simultaneously and independently and such that said case body and said lid are unlockable from the same both simultaneously and independently.

2. A personal security case as claimed in claim 1, wherein said lock is a key lock comprising a lock body defining a keyhole therein and a key, said lock and said three-way pawl member being connected in such a way that rotation of the key in said lock body rotates said three-way pawl member.

3. A personal security case as claimed in claim 1, wherein said lock comprises a pulse motor operatively connected to said three-way pawl member so as to rotate the same.

4. A personal security case as claimed in claim 1, wherein one of said holder and said case body has a groove therein, and the other of said holder and said case body has a ridge defined thereon and received in said groove, said ridge slidable in said groove to guide said security case into and out of said holder.

5. A personal security case as claimed in claim 4, wherein one of said case body and said lid defines a slot therethrough so as to allow a sheet to be inserted into said security case while said lid is locked to said case body in a closed state.

6. A personal security case comprising:

a holder attachable to a wall or the like, said holder defining a first engagement portion;

a security case removably held by said holder, said security case defining a second engagement portion, and said security case comprising a case body and a lid which is attached to said case body in such a manner as to be easily opened and closed as desired; and a lock mechanism provided on said security case, said lock mechanism including a lock, a three-way pawl member rotatably supported on said lock and having three pawls, a moveable engagement member movably mounted to and extending in said case body, and a spring biasing said movable engagement member inwardly of said case body to a normal position at which the moveable engagement member does not project from the outer surface of said case body, said three-way pawl member rotatable to and lockable at respective positions by said lock at which positions a said pawl presses said moveable engagement member outwardly of said case body and into engagement with said first engagement portion while another said pawl engages said second engagement portion, a said pawl presses said moveable engagement member outwardly of said case body and into engagement with said first engagement portion while the other said pawls are out of engagement with said second engagement portion, and a said pawl engages said second engagement portion while the other said pawls are out of pressing engagement with said moveable engagement member such that said case body and said lid are lockable to said holder and to said case body in a closed state, respectively, both simultaneously and independently and such that said case body and said lid are unlockable from the same both simultaneously and independently.

7. A personal security case as claimed in claim 6, wherein said lock is a key lock comprising a lock body defining a keyhole therein and a key, said lock and said three-way pawl member being connected in such a way that rotation of the key in said lock body rotates said three-way pawl member.

8. A personal security case as claimed in claim 6, wherein said lock comprises a pulse motor operatively connected to said three-way pawl member so as to rotate the same.

9. A personal security case as claimed in claim 6, wherein one of said holder and said case body has a groove therein, and the other of said holder and said case body has a ridge defined thereon and received in said groove, said ridge slidable in said groove to guide said security case into and out of said holder.

10. A personal security case as claimed in claim 9, wherein one of said case body and said lid defines a slot therethrough so as to allow a sheet to be inserted into said security case while said lid is locked to said case body in a closed state.

* * * * *